United States Patent [19]

Kruger et al.

[11] 4,424,516

[45] Jan. 3, 1984

[54] AROUND-THE-MAST ROTARY COUPLER WITH INDIVIDUAL POWER MODULE EXCITATION

[75] Inventors: Bradford E. Kruger; John C. Parr, both of Woodland Hills, Calif.

[73] Assignee: International Telephone and Telegraph Corporation, New York, N.Y.

[21] Appl. No.: 334,230

[22] Filed: Dec. 24, 1981

[51] Int. Cl.[3] ..... H01Q 3/02

[52] U.S. Cl. ..... 343/763; 333/261

[58] Field of Search ..... 343/762, 763; 333/261

[56] References Cited

U.S. PATENT DOCUMENTS 4,253,101 2/1981 Parr ..... 343/763

*Primary Examiner*—Eli Lieberman

*Attorney, Agent, or Firm*—T. E. Kristofferson; W. T. O'Neil

[57] ABSTRACT

An annular rotary RF coupler for installation about a vertical support structure, particularly the mast of a ship. Two annular volumes are regularly divided into circumferential increments providing a cellular structure of individual waveguide cross-sections. A first annulus (stator) remains fixed, the individual waveguide sections therein being fed in equal phase from individual solid-state transmit/receive modules. The oppositely facing annulus (rotor) rotates with respect to the first annulus about the common mechanical center of rotation both share with a mechanically rotating antenna system. Connection to the rotating waveguide sections may be through power combiner/divider means (more than one rotor cell per antenna element or subarray), or individual antenna elements or subarrays may be discretely connected to corresponding waveguide sections in the rotor. For power tapering across the antenna aperture, the waveguide (cell) section dimensions in the circumferential direction within the rotating annulus may be appropriately tailored.

8 Claims, 7 Drawing Figures

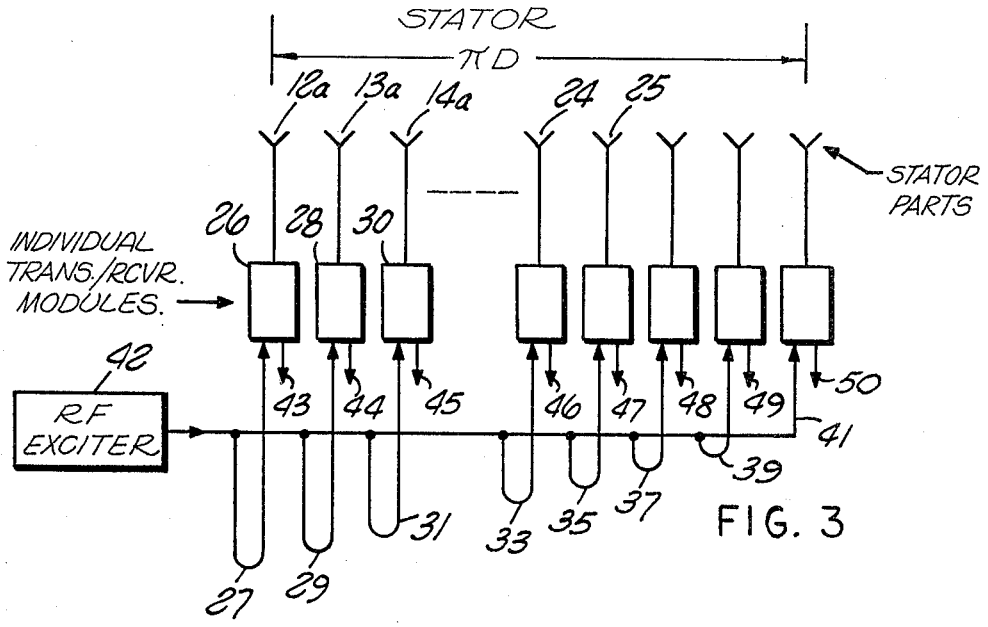
FIG. 3
FIG. 4
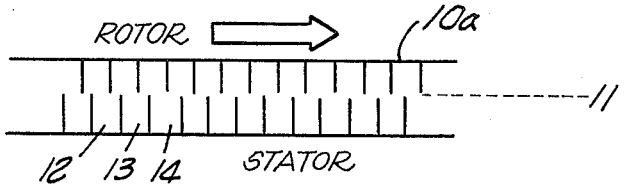
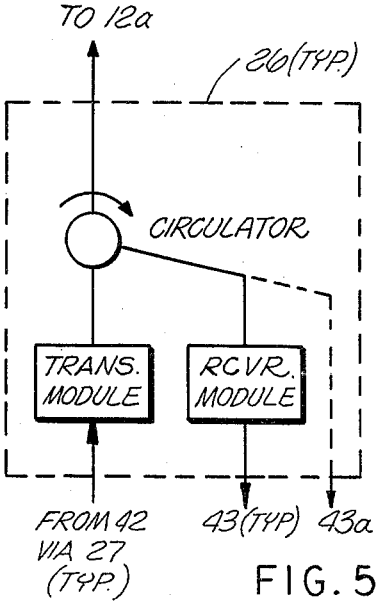
FIG. 5
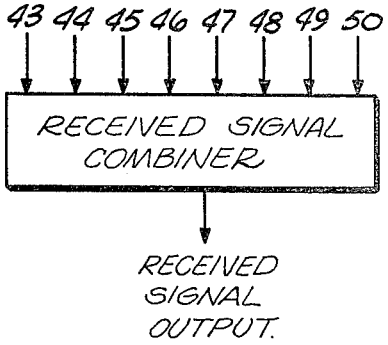
FIG. 6

AROUND-THE-MAST ROTARY COUPLER WITH INDIVIDUAL POWER MODULE EXCITATION

BACKGROUND OF THE INVENTION

1. Field of the Invention

The invention relates to radar antenna systems and more particularly to rotating RF joints to accommodate antenna mechanical rotation.

2. Description of the Prior Art

In the prior art, rotating RF couplings have been provided in a number of forms. A brief summary of their use is contained in the text "Radar Handbook," by Merrill I. Skolnik (McGraw-Hill 1970), in Chapter 8 under a paragraph entitled "Rotary Joints." Bibliographical references concerning the theory and design of rotary joints are contained in that summary.

The patent literature also includes description of prior art devices of conventional type, such as the apparatus of U.S. Pat. No. 2,751,559, for example.

In U.S. Pat. No. 3,896,446, a rotating RF joint is involved in a scanning radar system in which the antenna system is mounted over the top of a helicopter rotor to rotate with it; however, no advances in the rotary joint itself appear to be disclosed.

Other rotary RF joints, such as shown in U.S. Pat. No. 3,123,782 appear to be based on conductive circular ring arrangements and as such may be thought of as "slip-ring" devices.

Still further, systems not including sliding contacts but providing electromagnetic energy transfer in a rotating joint include multihorn configurations and the like. U.S. Pat. No. 3,803,619, and also U.S. Pat. Nos. 3,117,291 and 3,108,235 disclose devices of that type.

The slip-ring systems present well-known problems, such as arcing and mechanical wear, and the rotating horn devices are complex and costly and leave much to be desired in energy transfer efficiency.

In the most familiar prior art shipboard rotating antenna installations, lateral structural members affixed to mast structures have been required. Prior art rotary joints of the aforementioned and other conventional types have been applied in such instances. Many have used circular waveguide, coaxial transmission line sections or the like, providing rotatable conductive walls essentially concentric with the axis of rotation of the antenna structure itself.

The most modern shipboard radar installations have included mast-top or other "free space" mountings to avoid the blockage produced by parts of the ship's superstructure. Those mechanical configurations are best served by some form of "around-the-mast" RF rotary coupler.

In U.S. Pat. No. 4,222,055 entitled "Around-The-Mast Rotary Coupler," the principle prior art is shown and described, the improvement represented by the invention building from the basic system of that reference. Included in U.S. Pat. No. 4,222,055 are the basic interface, cellular rotor and stator annulus members associated with a typical planar array comprised of columns of radiating elements forming individual linear arrays separately excitable as indicated.

U.S. patent application Ser. No. 091,355 filed Nov. 5, 1979, entitled "A Fault-Tolerant Microwave Power Module Combiner Arrangement" (assigned to the assignee of this application) shows microwave circuitry instrumentable in strip-line medium, for example, for combining the outputs of a plurality of low-power solid state radio-frequency amplifier modules. That structure has background relevance in respect to the present invention because, as it will be seen as this description proceeds, the apparatus according to the invention inherently provides equivalent power combination division in a structure also providing the rotating joint function.

The manner in which the invention advances the state of the art in respect to radio-frequency rotary joints of the annular type for around-the-mast installation, while inherently providing certain other advantageous features and functions will be understood as this description proceeds.

SUMMARY

It may be said to have been the general objective of the invention to provide an annular radio-frequency rotary joint of the "around-the-mast" type which combines the advantages of prior art rotary RF joints of the same general type with a cooperating multi-module RF generating arrangement. The multiple RF modules are preferably of the solid-state amplifier type fed in a paralleled, equal-phase excitation arrangement. The inherent power combining capability of the interfaced double annulus rotary joint is exploited to provide an economical, efficient, and "fail soft" system consistent with the requirements for unattended or minimally attended continuously operative radar systems. According to the concept, a plurality of individual, relatively low-powered, solid-state radio frequency generating modules have their power outputs combined to produce a higher power signal comparable to that ordinarily provided by magnetrons, travelling wave tubes, power klystrons and the like.

Not only are the individual solid state RF generators inherently more reliable, i.e., they provide much longer service life, as compared to the aforementioned vacuum tube radio frequency power units, but as indicated in the aforementioned U.S. patent application Ser. No. 091,355 entitled "A Fault-Tolerant Microwave Power Module Combiner Arrangement," filed Nov. 5, 1979 (assigned to the assignee of the present case), circuits have been developed for the combination of the individual low-power module outputs and minimization of the adverse effect of individual module failures. The system thus fails "softly" in that substantial performance can be continued even after a few of the individual modules fail.

The objective of the invention is realized, as will be more fully understood from the detailed description hereinafter, and the most significant aspects of the invention may be summarized as follows:

There is provided a rotary, annular, radio-frequency, coupler system having rotor and stator members each including a distributed series of spaced conductive webs extending radially between radially spaced inner and outer concentric, conductive cylindrical surfaces, thereby dividing the rotor and stator members each into a series of circumferentially contiguous cells constituting individual short waveguide sections. These open, facing, waveguide sections form an annular, planar interface between the generally concentric rotor and stator subassemblies. The stator subassembly is normally fixed with respect to the support structure whereas the rotor turns about the common axis of rotor and stator with the rotation of the utilization device (ordinarily an antenna array).

The individual rotor cells are connected with or without intervening power combiners to the elements or columns of elements of the array, and the stator cells are each separately excited from a transmit/receive module which includes a low-power (normally solid-state) radio-frequency amplifier, a duplexer and a received energy output terminal. The multiple received energy outputs are combined either at radio frequency or after down conversion to IF frequency domain.

The unique combination which comprises the invention exploits the advantages of prior art annular rotary couplers as hereinbefore identified and also provides the "fail-soft" feature described. The loss of power due to the failure of a single one of the solid-state module transmit sources results in a power loss on the order of 2%, assuming one hundred modules and corresponding stator waveguide cells.

The details of a typical implementation according to the invention will be presented as this specification proceeds.

BRIEF DESCRIPTION OF THE DRAWINGS

FIG. 3 is a schematic block diagram illustrating the employment of multiple discrete transmit/receive solid-state modules for exciting the stator ports, according to the invention.

FIG. 4 illustrates a cutaway view of the stator of FIG. 2 with a matching rotor associated therewith.

FIG. 5 is a schematic block diagram of a typical individual transmit/receive module of FIG. 3.

FIG. 6 depicts a received signal combiner responsive to receive signal outputs of FIG. 3.

DETAILED DESCRIPTION

Figure 1:
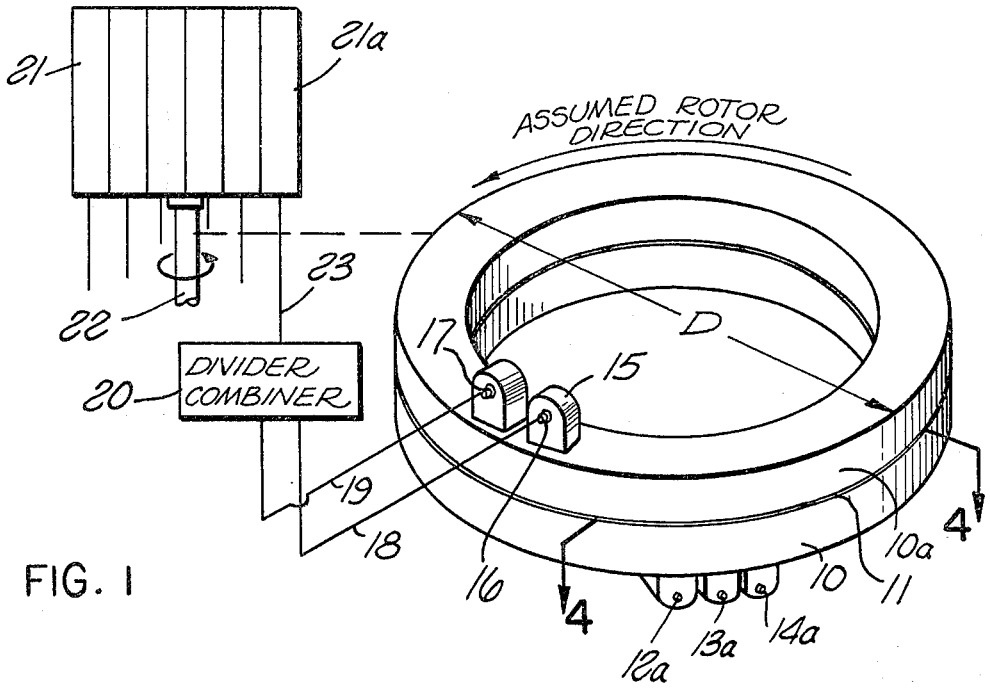
FIG. 1 is a partially pictorial representation of an annular rotary joint system according to either the prior art or the invention.

Referring now to FIG. 1, an annular rotary joint according to the invention and externally representative of the prior art is shown connected to a typical antenna array 21. The annular rotary joint comprises stator portion 10 which is fixed and connected by means of other apparatus to a transmit/receive equipment location. The rotor portion 10*a* rotates about the common center it has with the stator 10. A mast or other vertical support structure should be understood to pass through the open circular center space within 10 and 10*a*. An array such as 21 would typically be mounted with conventional mechanical rotational drive at the top of such a mast, the drive producing mechanical rotation of 10*a* slaved to array shaft 22. Those mechanical details are conventional, and need not be included within the inventive combination. It will be quite evident, however, that the configuration of FIG. 1 provides the capability of disposing an RF rotary joint around the outside perimeter of a mast, unlike earlier prior art situations in which a lateral arm has been required for the mounting of a rotating antenna array spaced away from the mast of the vessel so as to provide rotating array clearance with respect to the mast.

Through use of the configuration of FIG. 1, the rotating array can be mounted atop the mast structure or can be mounted to trace a circular path about the mast with the array boresite always pointing radially outward. In this way, the blockage and radiation pattern distortion resulting from the presence of the mast structure directly in front of the array at a particular angle is eliminated.

The rotor and stator subassemblies of FIG. 1, namely 10*a* and 10, respectively, have an annular interface generally represented at 11 on FIG. 1. Further description of the remaining elements depicted in FIG. 1 will await the description of other figures herewith, in order that the nature of these waveguide annular subassemblies 10 and 10*a* can first be described.

Figure 2A:
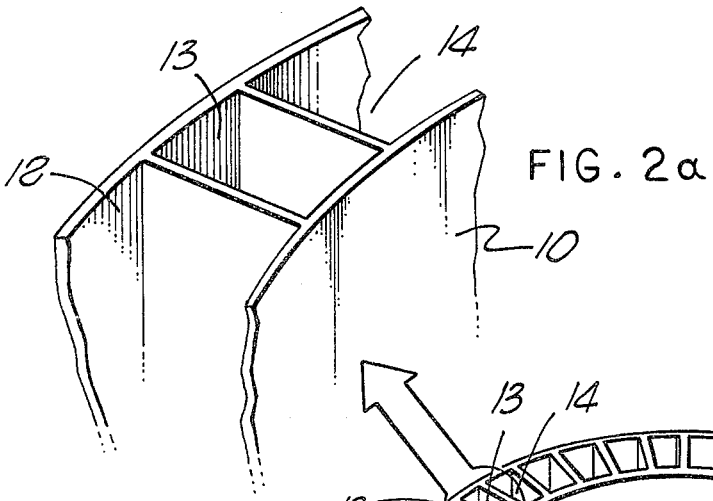
FIG. 2*a* is a magnified view of a portion of FIG. 2.
Figure 2:
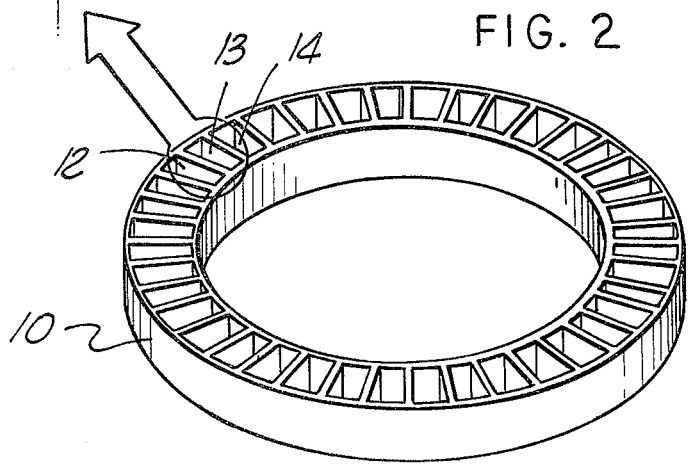
FIG. 2 is a simplified pictorial representation of the stator portion of a rotating joint of annular type according to the invention or the prior art.

Referring now to FIG. 2 and the magnified portion of FIG. 2 depicted in FIG. 2*a*, stator 10 is depicted independently with 10*a* removed for clarity. It will be seen that the annulus 10 is divided into individual waveguide cells or sections typically 12, 13 and 14. FIG. 2*a* more clearly shows these three particular waveguide cells (sections) in abutting positions so that the radially extending separating walls are common conductive walls between adjacent waveguide sections.

Although it would theoretically be possible to orient these typical waveguide sections such as 12, 13 and 14 with radially extending narrow walls and circumferentially measured broad walls, it is considered preferable and more convenient from a feed standpoint to have these individual cells oriented with broad waveguide walls extending radially and narrow walls orthogonal thereto. Since it is contemplated that the annular rotating joint or coupler employing the invention would be used on a major ocean-going vessel, the mast would be of substantial size and, therefore, the diameter of the rotor/stator assembly of 10*a* and 10 is relatively large. Accordingly, a fairly large number of waveguide sections or cells such as 12, 13 and 14 is required about the relatively large circumference involved. S or L (microwave) band waveguide sections are relatively small and, therefore, although each of these waveguide sections is actually trapezoidal in shape, the variation from rectangular is minimal and of negligible electrical significance.

The individual waveguide sections such as 12, 13 and 14 operate in the $TE_{10}$ mode and, accordingly, there are no RF currents of substantial magnitude between rotor and stator at the interface 11.

Looking ahead to FIG. 4, a partial cross-sectional view of the interfaced rotor and stator 10*a* and 10 taken as indicated on FIG. 1 is illustrated. The instantaneous rotational relative positions of 10 and 10*a* may be such that the radially extending walls of the rotor or stator sections each bisect the circumferential dimensions of the waveguide sections of the other. This situation is illustrated in FIG. 4, where waveguide sections of rotor 10*a* and stator 10*a* are shown in an instantaneous overlap position. The effect of this relative positioning or any positioning other than congruence on a one-for-one basis of rotor and stator waveguide sections at interface 11 is to divide the power transferred from a given waveguide section (of the stator, for example) between two adjoining waveguide sections of the rotor. The important consideration is the electric field uniformity achieved at the interface 11.

Wherever an array such as 21 comprises a plurality of columns of radiating elements, such as 21*a* (typical), some type of power dividing/combining arrangement is normally provided between these and a single-channel rotating joint in earlier prior art arrangements.

In addition to providing the around-the-mast capability, the configuration of FIG. 1 also has a corollary advantage in that it provides for inherent power division. Accordingly, separate transmission lines, typically 23, can provide discrete feed for the columns of radiators 21*a* (typ.) through lines such as 23.

These transmission lines can be discretely connected from one or a small fraction of the waveguide sections distributed about the rotating annulus (rotor) 10*a*. In this one-on-one case, a line such as 18 could feed through to line 23 directly and 19 could feed the next column of radiators adjacent to 21*a*. The separate divider/combiner 20 would then be unnecessary.

Although there is no serious electrical reasons for chokes or other elaborate electrical protection at the interface 11 (FIG. 1), an environmental cover is obviously desirable. This can be produced by any known mechanical expedient which would be conventional under the circumstances.

Referring now to FIG. 3, a schematic block diagram depicting the arrangement of individual transmit/-receive modules is shown. These modules 26, 28, 30, 32, 34, 36, 38 and 40 are typical and, of course, not intended to include all such modules in a practical implementation of the invention. A typical one of these modules is shown in detail in FIG. 5 and will be hereinafter described.

Each of the individual transmit/receive modules 26–40 is preferably implemented in solid-state medium and frequently with strip-line or microstrip interconnection. The nature of these modules is well-known in the art and readily implemented by those of skill therein. In FIG. 5, one of these modules identified as 26 is depicted. The circulator 53 provides the duplexer function and is very conveniently implemented in microstrip or strip-line medium. The transmit module 51 may be only a radio-frequency amplifier, the common radio-frequency signal to all modules being supplied from RF exciter 42. The exciter energy paths to the various individual modules are depicted to indicate the uniform or equal-phase excitation provided thereto. That is, the RF excitation from 42 reaches the transmit module 51 within the transmit/receive module 26 via path 27 so that the phase delay directly into transmit module 51 from 42 is equal to that received by the transmit portion of each of the other transmit/receive modules 28–40. Of course, it will be realized that the excitation paths 21, 31, 33, 35, 37, 39 and 41 are also constructed to serve this equal-phase excitation objective.

It will also be noted that, if a circular layout is implemented for the components of FIG. 3, the excitation paths to the individual transmit/receive modules may be in radial form from a center point, in which case no actual path length difference from 42 would be required. The equal path concept represented in 27, 29, 31, 33, 35, 37, 39 and 41 nevertheless illustrates the need for phase uniformity in the excitation and, therefore, phase uniformity in the typical stator cell ports 12*a*, 13*a*, 14*a*, 24 and 25 and at interface 11. The connections from the individual transmit/receive modules to those stator ports are, of course, similarly equalized.

Referring again to FIG. 5, it will be seen that a receiver module 52 is illustrated providing an output 43 corresponding to module 26. This receiver module 52 may include simple detection or heterodyne down-conversion so that the output 43 is in the IF domain.

FIG. 6 illustrates a received signal combiner 54 responsive to each of the receiver modules 52 in 26, 28, 30, etc. Here are the individual receiver module outputs 43, 44, 45, 46, 47, 48, 49 and 50 are combined and further amplified as required and outputted as a received signal either at an IF frequency or fully detected to the video domain.

In FIG. 5, an additional optional output 43*a* is indicated, it being possible to take the radio-frequency signal directly to the combiner 54 in which case input 43 would be 43*a*, etc. on FIG. 6. Combination of these radio-frequency signals in a conventional RF signal combiner can then be effected with single channel superheterodyne receiving components following according to conventional implementations.

The typical coaxial line-to-waveguide transition, such as at 15 in FIG. 1, is employed at each of the rotor and stator cells. A stub or probe is suspended in cantilever fashion within the domed or radiused portion of the conductive enclosure 14. The coaxial connector 17 is, of course, conductively associated from its outer shell to 15, and to the aforementioned probe from its center conductor. All such lines as 18 and 19 in FIG. 1 and all other stator and rotor connections would be presumed to be via coaxial line, although the use of coaxial lines is not strictly a requirement of the invention. Coaxial interconnections are, nevertheless, very convenient and inexpensive.

Modifications and variations will suggest themselves to those skilled in this art once the principles of the present invention are thoroughly understood. Accordingly, it is not intended that the scope of the invention should be regarded as limited to the drawings or this description, these being typical and illustrative only.

What is claimed is:

1. A rotary, annular, radio-frequency, coupler system having rotor and stator members each including a distributed series of spaced conductive webs extending radially between radially spaced inner and outer concentric conductive cylindrical surfaces to divide said rotor and stator members into a series of circumferentially contiguous cells, said rotor and stator members each being open and facing each other at an annular planar interface, said rotor and stator being arranged concentrically, having said inner cylindrical surfaces of each of substantially the same diameter and said outer surfaces of each of the same diameter, thereby forming an annular interface within said planar interface for transfer of radio-frequency energy between said rotor and said stator, and comprising:

first means including a plurality of discrete transmit/-receive modules each of which is connected discretely to a corresponding one of said stator cells, said first means including means for feeding said modules in parallel during a transmit mode; and second means within each module of said first means for receiving signal energy in each corresponding cell during a receiving mode, said second means including individual duplexing means associated wih each of said modules for separating the operation of said modules between transmit and receive modes.

2. The coupler system according to claim 1 further defined in that said second means comprises means for individually frequency reducing said received energy signals from each of said cells at least to the intermediate frequency domain, and in which means are included for combining the plurality of said reduced signals to produce a combined receive signal during said receive mode.

3. The coupler system according to claim 1 further defined in that said duplexing means each provide a discrete received signal output during said receive mode at substantially the same frequency as that provided by said modules during said transmit mode.

4. A rotary coupler system according to claims 1, 2 or 3 in which said conductive webs form the broad walls of the waveguide sections of each of said cells.

5. A rotary coupler system according to claims 1, 2 or 3, including an antenna array and in which said rotor cells are each connected to a corresponding element or column of elements of said antenna array, thereby to provide signal energy transfer between said array and said first and second means.

6. A rotary coupler system according to claims 1, 2 or 3, including an antenna array and in which combiner/-divider means are included whereby a plurality of cells of said rotor are connected to each corresponding element or column of elements of said antenna array.

7. The system according to claim 1 or 3 in which said duplexing means comprising a three port circulator and said modules each include a solid state radio-frequency amplifier.

8. The system of claim 1 in which said second means includes means for providing individual received radio-frequency signals from said duplexers and in which a radio-frequency received signal combiner is included.

* * * * *